US010246950B2

(12) United States Patent
Nikiforuk

(10) Patent No.: US 10,246,950 B2
(45) Date of Patent: Apr. 2, 2019

(54) DEADLINE COMPENSATOR

(71) Applicant: Nabors Drilling Technologies USA, Inc., Houston, TX (US)

(72) Inventor: Kevin James Nikiforuk, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 890 days.

(21) Appl. No.: 14/615,119

(22) Filed: Feb. 5, 2015

(65) Prior Publication Data

US 2016/0229670 A1 Aug. 11, 2016

(51) Int. Cl.

| | |
|---|---|
| ***E21B 19/086*** | (2006.01) |
| ***E21B 19/00*** | (2006.01) |
| *B66D 1/50* | (2006.01) |

(52) U.S. Cl.

CPC ..... *E21B 19/086* (2013.01); *E21B 19/008* (2013.01); *B66D 1/50* (2013.01)

(58) Field of Classification Search

CPC ..... B66D 1/38; B66D 1/50; E21B 19/008; E21B 19/086

See application file for complete search history.

(56) References Cited

U.S. PATENT DOCUMENTS

| | | | | |
|---|---|---|---|---|
| 3,606,854 | A * | 9/1971 | Van Lunteren | B63C 11/44 114/230.27 |
| 4,285,502 | A * | 8/1981 | Lub | B66D 1/50 226/118.2 |
| 5,342,020 | A * | 8/1994 | Stone | B66D 1/485 254/269 |
| 9,834,417 | B2 * | 12/2017 | Jewell | B66C 13/18 |
| 2014/0246635 | A1 * | 9/2014 | Yi | E02D 3/046 254/386 |

* cited by examiner

*Primary Examiner* — Sang K Kim
*Assistant Examiner* — Nathaniel L Adams
(74) *Attorney, Agent, or Firm* — Abel Law Group, LLP; Enrique Abarca

(57) ABSTRACT

A deadline compensator including a compensator assembly configured to engage a deadline between a crown block and a supply reel. The compensator assembly is configured to transition between a first position and a second position. The deadline compensator also includes at least one compensator sheave of the compensator assembly. The compensator sheave is configured to engage the deadline. The deadline compensator includes at least one actuator of the compensator assembly. The actuator is configured to apply a force to the deadline via the at least one compensator sheave to displace the deadline while the compensator assembly is in the first position and configured to retract into the second position in response to force applied via the deadline.

16 Claims, 5 Drawing Sheets

DEADLINE COMPENSATOR

BACKGROUND

Embodiments of the present disclosure relate generally to the field of drilling and processing of wells. More particularly, present embodiments relate to a system for compensating for slack in a deadline of a drilling rig.

Deadlines are typically utilized during drilling operations to couple a drilling line to a supply reel to supply new sections of drilling line during slip and cut operations. In conventional oil and gas operations, a hoisting system suspends a traveling block above a rig floor. The hoisting system enables the traveling block to move vertically within a derrick to move drilling equipment between the rig floor and a crown block near the top of the derrick. The drilling line extends from a drawworks to the crown block and through a series of sheaves. Additionally, the non-moving portion of the drilling line, known as the deadline, extends from the sheaves to the supply reel. As the drilling line begins to fatigue (e.g., via repeated movement of the traveling block) the drilling line is cut and a new section of drilling line is supplied from the supply line.

BRIEF DESCRIPTION

In an embodiment a deadline compensator includes a compensator assembly configured to engage a deadline between a crown block and a supply reel. The compensator assembly is configured to transition between a first position and a second position. The deadline compensator also includes at least one compensator sheave of the compensator assembly. The compensator sheave is configured to engage the deadline. The deadline compensator includes at least one actuator of the compensator assembly. The actuator is configured to apply a force to the deadline via the at least one compensator sheave to displace the deadline while the compensator assembly is in the first position and configured to retract into the second position in response to force applied via the deadline.

In another embodiment a deadline compensator for removing slack from a deadline includes a first compensator assembly moveable between a first position and a second position. The first compensator assembly is configured to guide the deadline through the deadline compensator while in the first position and to displace the deadline a first distance in a first direction while in the second position. The deadline compensator also includes a second compensator assembly moveable between the first position and the second position and adjacent to the first compensator assembly. The second compensator assembly is configured to displace the deadline a second distance in a second direction while in the second position, wherein the second direction is opposite the first direction. Additionally, the deadline compensator includes a third compensator assembly positioned between the second compensator assembly and a deadline anchor. The third compensator assembly is configured to guide the deadline toward the second compensator assembly.

In a further embodiment a system includes a support structure having legs and braces configured to couple to a drilling rig and a compensator assembly disposed within the support structure. The compensator assembly is moveable between a first position and a second position such that the compensator assembly is configured to apply a force to a deadline and displace the deadline while in the second position. The system also includes a support compensator assembly coupled to the support structure and configured to guide the deadline toward the compensator assembly. The support compensator assembly is positioned between the compensator assembly and a deadline line anchor.

DRAWINGS

These and other features, aspects, and advantages of the presently disclosed embodiments will become better understood when the following detailed description is read with reference to the accompanying drawings in which like characters represent like parts throughout the drawings, wherein.

DETAILED DESCRIPTION

Present embodiments provide a deadline compensator configured to remove slack from a deadline during drilling operations. The deadline compensator may include compensator assemblies configured to apply a force to the deadline, thereby displacing the deadline within the deadline compensator and removing slack in the line. In certain embodiments, the deadline may experience a variety of load conditions during drilling operations. For example, the deadline may be subject to a first load condition while a traveling block is in a fully loaded condition (e.g., drilling equipment plus tubulars being added to a drill string). In the first load condition, minimal or no slack may be present in the deadline. However, during drilling operations the traveling block may encounter an obstruction, thereby creating slack in the deadline and a second load condition. Moreover, the traveling block may also apply a third load condition to the deadline due to the weight of the traveling block itself without additional tubulars, equipment, or the like. The deadline compensator is configured to remove the slack in the deadline during the second and third load conditions, thereby dampening the impact of the second and third load conditions on the drilling operations.

Figure 1:
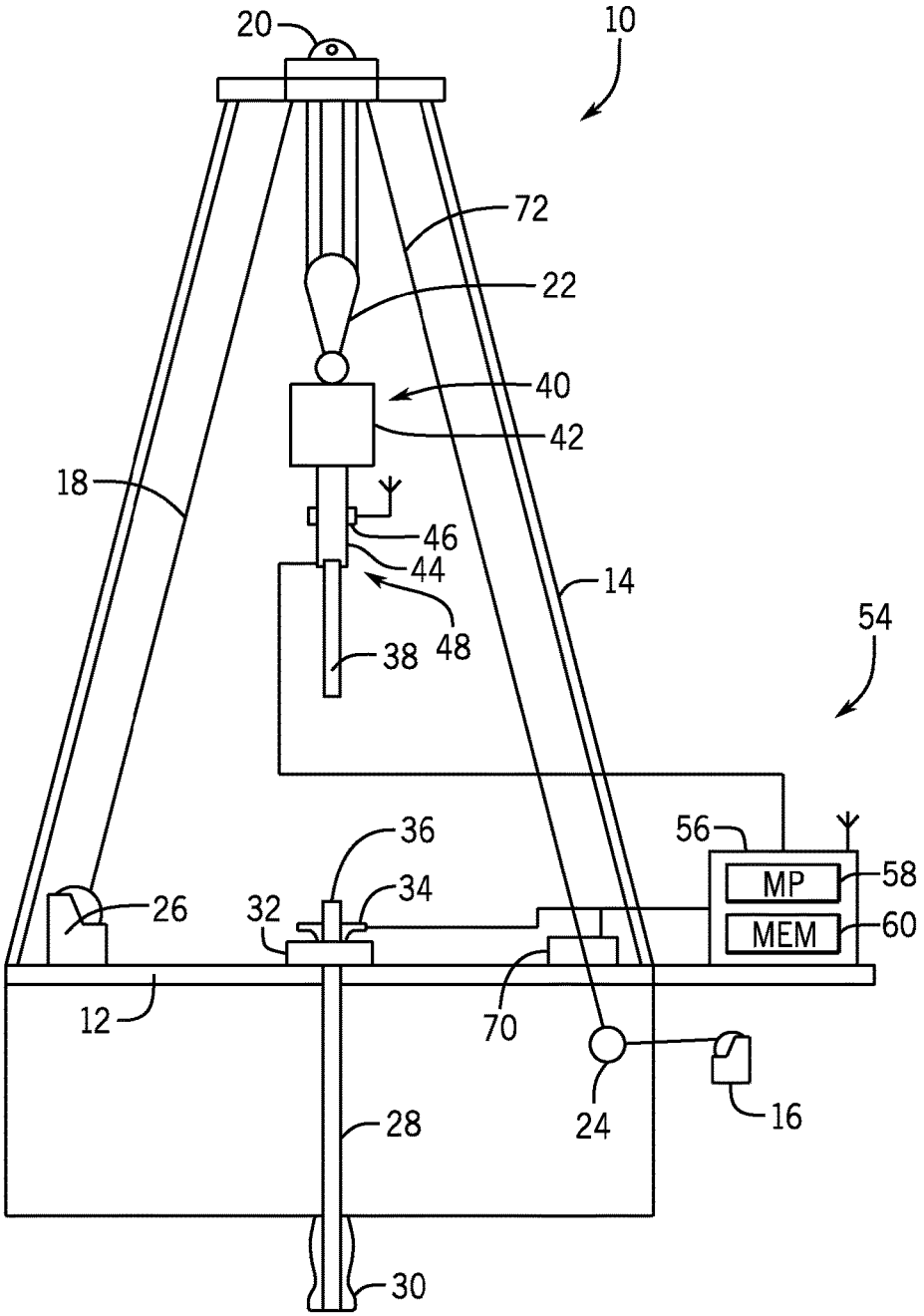
FIG. 1 is a schematic of an embodiment of a well being drilled with a deadline compensator, in accordance with present techniques.

Turning now to the drawings, FIG. 1 is a schematic view of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34 (e.g., power slips). A portion of the drill string 28 extends above the rig floor 12, forming a stump 36 to which another length of tubular 38 (e.g., a joint of drill pipe, a section of casing) may be added.

A tubular drive system 40, hoisted by the traveling block 22, positions the tubular 38 above the wellbore 30. In the illustrated embodiment, the tubular drive system 40 includes a top drive 42, a gripping device 44, and a tubular drive monitoring system 46 (e.g., an operating parameter monitoring system) configured to measure forces acting on the tubular drive system 40, such as torque, weight, and so forth. For example, the tubular drive monitoring system 46 may measure forces acting on the tubular drive system 40 via sensors, such as strain gauges, gyroscopes, pressure sensors, accelerometers, magnetic sensors, optical sensors, or other sensors, which may be communicatively linked or physically integrated with the system 46. The gripping device 44 of the tubular drive system 40 is engaged with a distal end 48 (e.g., box end) of the tubular 38. The tubular drive system 40, once coupled with the tubular 38, may then lower the coupled tubular 38 toward the stump 36 and rotate the tubular 38 such that it connects with the stump 36 and becomes part of the drill string 28.

The drilling rig 10 further includes a control system 54, which is configured to control the various systems and components of the drilling rig 10 that grip, lift, release, and support the tubular 38 and the drill string 28 during a casing running or tripping operation. For example, the control system 54 may control operation of the gripping device 44 and the power slips 34 based on measured feedback (e.g., from the tubular drive monitoring system 46 and other sensors) to ensure that the tubular 30 and the drill string 28 are adequately gripped and supported by the gripping device 44 and/or the power slips 34 during a casing running operation. In this manner, the control system 54 may reduce and/or eliminate incidents where lengths of tubular 38 and/or the drill string 28 are unsupported. Moreover, the control system 54 may control auxiliary equipment such as mud pumps, robotic pipe handlers, and the like.

In the illustrated embodiment, the control system 54 includes a controller 56 having one or more microprocessors 58 and a memory 60. For example, the controller 56 may be an automation controller, which may include a programmable logic controller (PLC). The memory 60 is a non-transitory (not merely a signal), tangible, computer-readable media, which may include executable instructions that may be executed by the microprocessor 56. The controller 56 receives feedback from the tubular drive monitoring system 46 and/or other sensors that detect measured feedback associated with operation of the drilling rig 10. For example, the controller 56 may receive feedback from the tubular drive system 46 and/or other sensors via wired or wireless transmission. Based on the measured feedback, the controller 56 regulates operation of the tubular drive system 46 (e.g., increasing rotation speed).

Returning to the hoisting system, a deadline compensator 70 is positioned between the deadline anchor 24 and the crown block 20. For example, in the illustrated embodiment, the deadline compensator 70 is positioned on the rig floor 12 between the deadline anchor 24 and a sheave of the crown block 20. However, in other embodiments, the deadline compensator 70 may be positioned below the rig floor 12, above the rig floor 12, or at any other suitable location based on the operating environment. For instance, the deadline compensator 70 may be placed at the rig floor 12 to facilitate routine maintenance operations. As will be described in detail below, the deadline compensator 70 is configured to apply a force to a deadline 72 to enable dampening of the deadline 72 in response to slack in the deadline 72 during drilling operations.

During operation, the traveling block 22 is configured to move up and down relative to the rig floor 12. During the movement, the traveling block 22 may couple to additional drilling accessories, thereby increasing the load in the drilling line 18 and the deadline 72. For example, in some instances, the traveling block 22 may be coupled to the tubular 38 and lowered toward the rig floor 12 via the drilling line 18. The traveling block 22 may be lowering the tubular 38 toward the stump 36 to couple the tubular 38 to the drill string 28 disposed within the wellbore 30. In certain embodiments, the tubular 38 is threaded to the drill string 28. Accordingly, as operators position the tubular 38 above the drill string 28, the tubular 38 may strike the drill string 28 resulting in undesirable wear and tear to the threaded ends of the tubulars 38. To that end, the deadline compensator 70 is configured to dampen the movement of the traveling block 22 as is moves up and down relative to the rig floor 12.

Additionally, the traveling block 22, and therethrough the deadline 72, may be exposed to multiple load conditions while the traveling block 22 is moving within the derrick 14. For example, the deadline 72 may be in a first load condition in which the load on the deadline 72 includes the traveling block 22 and equipment associated with the traveling block 22 (e.g., the tubulars 38). For example, the traveling block 22 may place the deadline 72 in the first load condition while coupled to the tubular 38. As a result, slack in the deadline 72 may be limited because of the weight acting on the deadline 72 due to the traveling block 22, the tubular 38, and/or other drilling equipment. Moreover, the deadline 72 may be in a second load condition in which the load applied to the traveling block 22 encounters an obstruction, such as the tubular 38 striking the drill string 28. In the second load condition, the slack in the deadline 72 may be greater than the slack during the first load condition. To this end, the deadline compensator 70 is configured to substantially remove the slack in the deadline 72 to prevent or substantially reduce the likelihood that the tubular 38 strikes the drill string 28, thereby potentially improving the useful life of the threaded connections utilized to couple the tubular 38 to the drill string 28. Furthermore, the deadline 72 may be in a third load condition in which the load on the deadline 72 is smaller than the first load condition, but greater than the second load condition. For example, the third load condition may be the result of the weight of the traveling block 22 without the tubular 38 (e.g., after the tubular 38 is coupled to the drillstring 28).

It should be noted that the illustration of FIG. 1 is intentionally simplified to focus on the deadline compensator 70 of the drilling rig 10, which is described in greater detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform. While only certain features of the invention have been illustrated and described herein, many modifications and changes will occur to those skilled in the art. It is, therefore, to be understood that the appended claims are intended to cover all such modifications and changes as fall within the true spirit of the invention.

Figure 2:
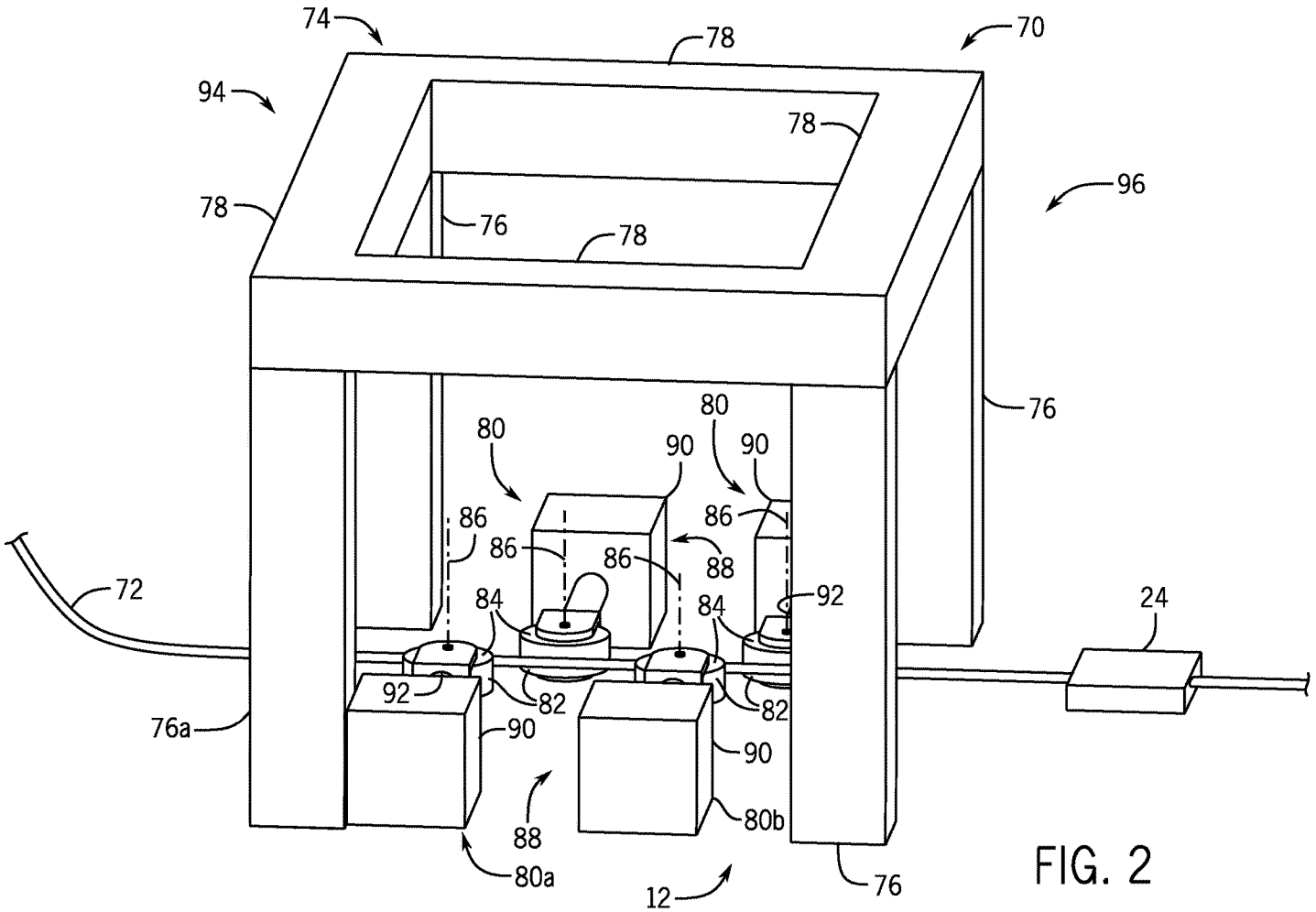
FIG. 2 is a perspective view of the deadline compensator of FIG. 1, in which the deadline compensator is coupled to a deadline.

FIG. 2 is a perspective view of the deadline compensator 70 coupled to the deadline 72. In the illustrated embodiment, the deadline 72 extends through a support structure 74 of the deadline compensator 70. The support structure 74 includes legs 76 and braces 78 to provide structural support for the compensator assemblies 80. For example, in the illustrated embodiment, the compensator assembly 80*a* is coupled to the leg 76*a*. Accordingly, forces applied to the compensator assembly 80*a* may be transferred to the leg 76*a*, thereby enabling the compensator assembly 80*a* to be constructed with lighter, smaller materials. However, in other embodiments, the compensator assemblies 76 may be coupled to the braces 78, the rig floor 12, the ground, walls or supports extending between elements of the support structure 74, or a combination thereof. For example, the compensator assembly 80*b* is disposed on the rig floor 12. While the illustrated embodiment includes a specifically delineated embodiment of the support structure 74 for the deadline compensator 70, it is appreciated that in other embodiments the deadline compensator 70 may not have the support structure 74. For example, the deadline compensator 70 may be integrated into the rig floor 12, the derrick 14, the crown block 20, any other suitable component of the drilling rig 10, or a combination thereof.

In the illustrated embodiment, the compensator assemblies 80 are configured to apply a force to the deadline 72 via compensator sheaves 82 to remove slack from the deadline 72 during drilling operations. The compensator sheaves 82 include a groove 84 configured to receive and to guide the deadline 72. The groove 84 may be recessed relative to the surrounding portions of the compensator sheave 82 (e.g., radially closer to a center of the sheave than the surrounding portions). Moreover, the groove 84 guides the deadline 72 along the compensator sheave 82. In certain embodiments, the compensator sheaves 82 are configured to rotate about a sheave axis 86. Rotation of the compensator sheave 82 about the sheave axis 86 facilitates movement of the deadline 72 along the compensator sheaves 82 and reduces the potential for obstructions as the supply reel 16 feeds drilling line 18 back to the drawworks 26 during slip and cut operations.

Moreover, the compensator assemblies 80 include actuators 88 configured to move the compensator sheaves 82 between a first position (e.g., a position in which a small force or no force is applied to the deadline 72) and a second position (e.g., a position in which a larger force is applied to the deadline 72). For example, the actuators 88 may be hydraulic cylinders (e.g., hydraulic motors) configured to linearly displace the compensator sheaves 82 relative to a body 90 of the compensator assembly 80. As will be appreciated, in embodiments where the actuators 88 are hydraulic cylinders, the hydraulic cylinder may include a cylinder body having a piston rod configured to extend and retract relative to the cylinder body due to hydraulic pressure applied to a piston at a base of the piston rod. As will be described below, the hydraulic pressure may be supplied by a hydraulic pump fluidly coupled to the hydraulic cylinder and a fluid reservoir. Accordingly, the compensator assemblies 80 including actuators 88 may be referred to as dynamic or moveable compensator assemblies 80.

Additionally, in certain embodiments, the compensator assemblies 80 may not include the actuators 88. Rather, the compensator assemblies 80 may include rigid or semi-rigid arms 92 configured to hold the compensator sheaves 82 at a substantially uniform position relative to the body 90 of the compensator assembly 80. Accordingly, the compensator assemblies 80 including arms 92, rather than actuators 88, may be referred to as static or stationary compensator assemblies 80. As will be described below, the stationary compensator assemblies 80 are configured to guide the deadline 72 through the deadline compensator 70 and to enable the moveable compensator assemblies 80 to apply a force to the deadline 72 in response to a force applied to the drilling line 18.

While the illustrated embodiment includes the compensator assemblies 80 arranged such that the compensator sheaves 82 are positioned horizontally (e.g., the sheave axis 86 is substantially perpendicular to the rig floor 12), in other embodiments the compensator assemblies 80 may be positioned in other orientations. For example, the compensator assemblies may be positioned such that the sheave axis 86 is parallel to the rig floor 12, or in any other suitable orientation that enables the compensator sheaves 82 to engage the deadline 72. Moreover, while four compensator assemblies 80 are shown in the illustrated embodiment, in other embodiments there may be 1, 2, 3, 5, 6, 7, 8, 9, 10, or any suitable number of compensator assemblies 80 to sufficiently dampen the deadline 72 during drilling operations.

Figure 3:
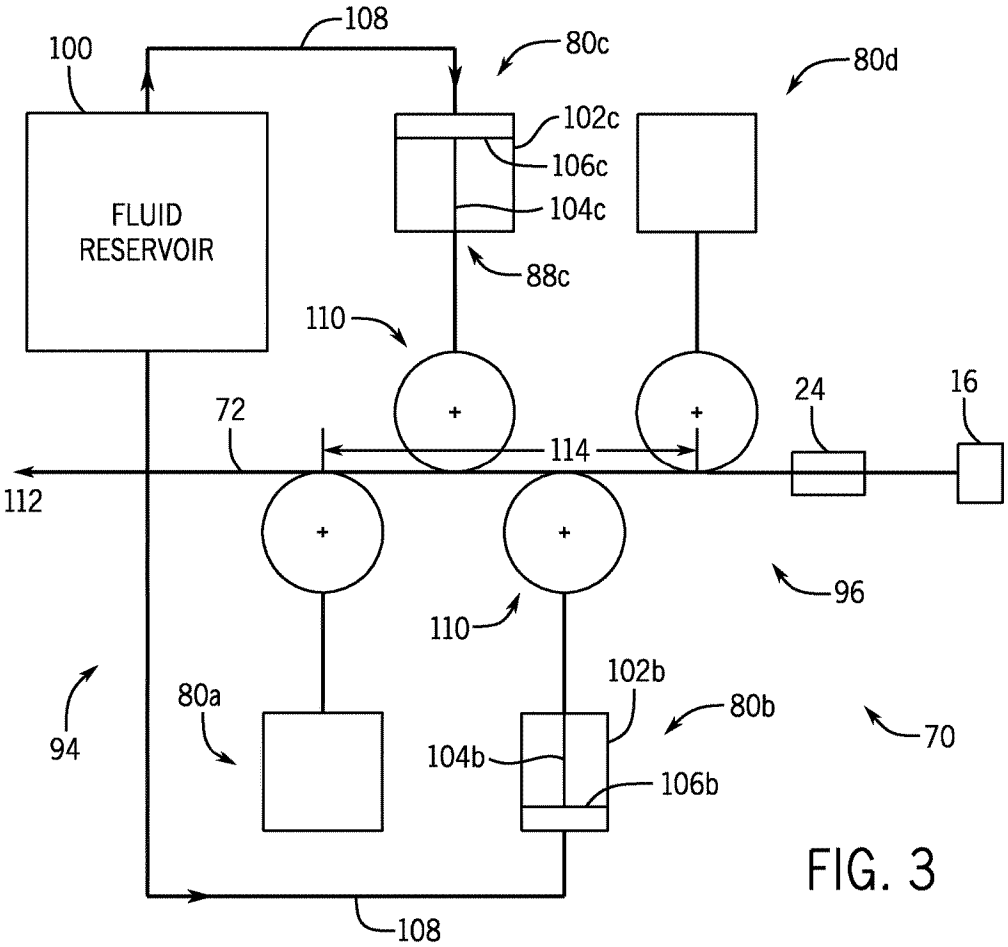
FIG. 3 is a schematic of the deadline compensator of FIG. 2, in which a first load condition is acting on the deadline, in accordance with present techniques.

FIG. 3 is a schematic diagram of the deadline compensator 70 in which the moveable compensator assemblies 80*b*, 80*c* are in a first position subject to a first load condition. In the illustrated embodiment, the stationary compensator assemblies 80*a*, 80*d* are positioned proximate a first end 94 and a second end 96 of the deadline compensator 70, respectively. The stationary compensator assembly 80*d* is positioned closer to the deadline anchor 24 than the stationary compensator assembly 80*a*. However, in other embodiments, there may be only one stationary compensator assembly 80. As described above, the stationary compensator assemblies 80*a*, 80*d* are configured to guide the deadline 72 through the deadline compensator 70 and to provide a rigid or semi-rigid anchor point for the deadline 72. The deadline 72 is configured to engage the groove 84 of the compensator sheaves 82 as the deadline 72 is routed through the deadline compensator 70.

Furthermore, in the illustrated embodiment, a fluid reservoir 100 is fluidly coupled to the actuators 88 of the moveable compensator assemblies 80*b*, 80*c*. As described above, in certain embodiments the actuators 88 include hydraulic cylinders having a cylinder body 102, a piston rod 104, and a piston 106. The fluid reservoir 100 is configured to supply fluid to the cylinder body 102 via a flow line 108 to apply a force to the piston 106 to enable the piston rod 104 to extend from the cylinder body 102. In certain embodiments, the fluid reservoir 100 may be coupled to a pump configured to supply the fluid to the actuators 88. As will be appreciated, supplying fluid to the cylinder body 102 will facilitate extension of the piston rod 104 out of the cylinder body 102, while removing fluid from the cylinder body 102 will facilitate retraction of the piston rod 104 into the cylinder body 102.

In the illustrated embodiment, the moveable compensator assemblies 80*b*, 80*c* are in a first position 110, in which the piston rods 104*b*, 104*c* are retracted within the cylinder bodies 102*b*, 102*c*. Moreover, a first load condition 112 acts on the deadline 72. The first load condition 112 may be the result of the traveling block 22 coupled to the tubular 38 (or other associated drilling equipment) as the traveling block 22 moves the tubular 38 toward the drill string 28. Because the deadline 72 is coupled to the drilling line 18 supporting the traveling block 22, the first load condition 112 acting on the traveling block 22 also acts on the deadline 72. Accordingly, the deadline 72 has substantially no slack due to the first load condition 112 acting on the deadline 72. That is, the first load condition 112 supplies a sufficient tension to the drilling line 18 to keep the deadline 72 substantially taut while the first load condition 112 acts on the deadline 72. As a result, the deadline 72 is positioned within the grooves 84 of the compensator sheaves 82 as the traveling block 22 moves toward the rig floor 12. However, as mentioned above, the compensator assemblies 80 may not apply an appreciable force to the deadline 72 while the first load condition 112 acts on the deadline 72.

As mentioned above, the deadline 72 is configured to extend from the crown block 20 to the supply reel 16. Moreover, the deadline 72 is configured to remain substantially stationary during drilling operations. In the illustrated embodiment, the deadline 72 has a first length 114 extending from the stationary compensator assembly 80*a* to the stationary compensator assembly 80*d*. As will be described in detail below, under other load conditions the moveable compensator assemblies 80*b*, 80*c* are configured to extend to maintain a force applied to the deadline 72, thereby utilizing a larger portion of the deadline 72 within the first length 114 to maintain tautness in deadline 72 and substantially dampen the deadline 72 during drilling operations conducted utilizing a load condition less than the first load condition 112.

Figure 4:
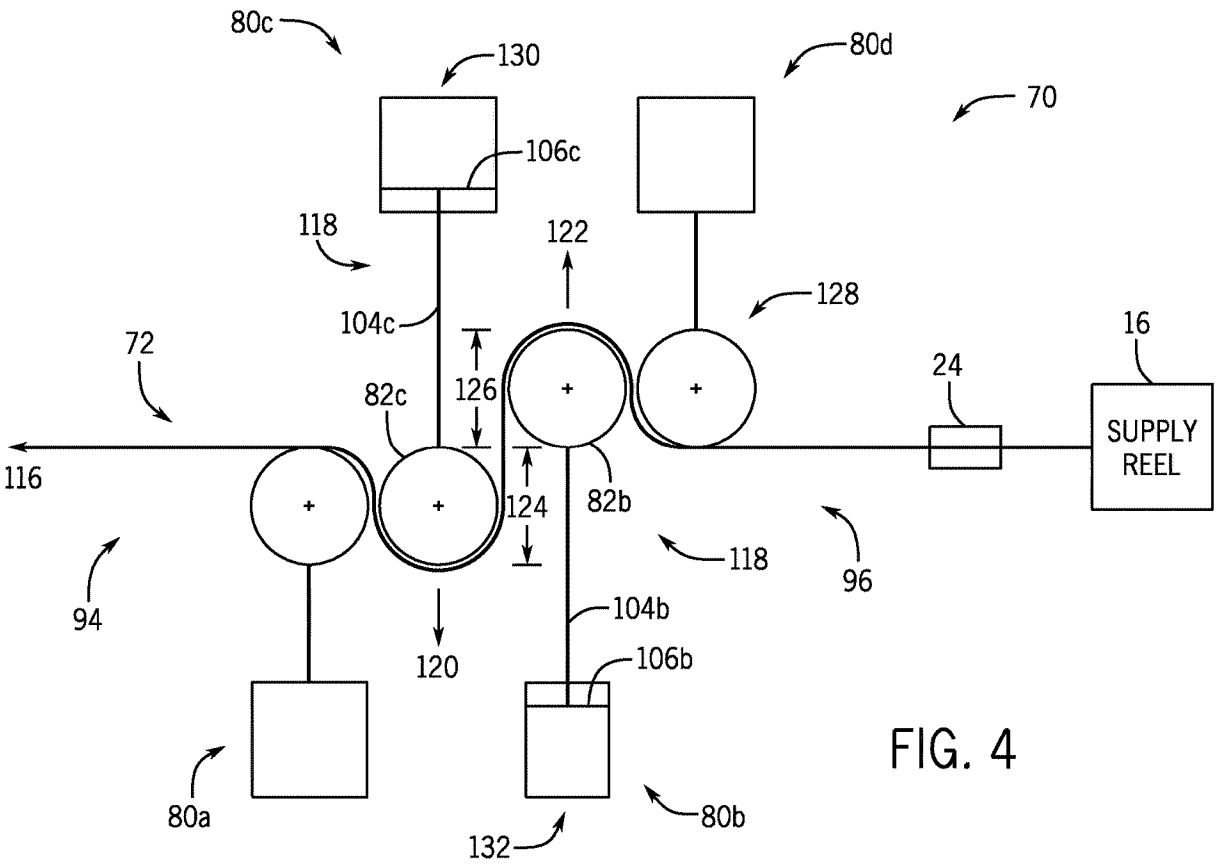
FIG. 4 is a schematic of the deadline compensator of FIG. 2, in which a second load condition is acting on the deadline, in accordance with present techniques.

FIG. 4 is a schematic diagram of the deadline compensator 70 in which a second load condition 116 is applied to the deadline 72. As mentioned above, the second load condition 116 may be the result of the tubular 38 encountering an obstruction (e.g., the drill string 28) as the traveling block 22 lowers the tubular 38 toward the rig floor 12. For example, the tubular 38 may be lowered toward the drill string 28 to engage threaded connections of the tubular 38 and the drill string 28. However, in certain embodiments, it may be desirable to provide some additional travel of the tubular 38 toward the drill string 28 to account for manufacturing tolerances and the like. While the additional travel may be beneficial for engaging the threaded connections, in certain embodiments the tubular 38 may strike the drill string 28, leading to potential wear and tear on the threaded connections. Accordingly, the deadline compensator 70 is configured to apply a force to the deadline 72 to take up the slack in the deadline 72 as a result of the contact between the tubular 38 and the drill string 28.

In the illustrated embodiment, the compensator assembly 80*c* (hereinafter the first compensator assembly 80*c*) and the compensator assembly 80*b* (hereinafter the second compensator assembly 80*b*) are both in a second position 118 in which the piston rods 104*b*, 104*c* are extended from the cylinder bodies 102*b*, 102*c*. That is, the fluid from the fluid reservoir 100 is directed toward the first and second compensator assemblies 80*c*, 80*b* to drive the piston rods 104*b*, 104*c* from the cylinder bodies 102*b*, 102*c*. As a result a first force 120 is applied to the deadline 72 by the first compensator assembly 80*c* and a second force 122 is applied to the deadline 72 by the second compensator assembly 80*b*. The first and second forces 120, 122 are configured to displace the deadline 72 and take up the slack in the deadline 72, thereby dampening and/or blocking the potential contact between the tubular 38 and the drill string 28.

As discussed above, the deadline 72 extends the first length 114 between the stationary compensator assemblies 80*a*, 80*d*. However, due to the first and second forces 120, 122 applied to the deadline 72, a larger segment of the deadline 72 is contained in the deadline compensator 70 (e.g., between the stationary compensator assemblies 80*a*, 80*d*). For example, the first compensator assembly 80*c* displaces the deadline 72 a first distance 124. Moreover, the second compensatory assembly 80*d* displaces the deadline 72 a second distance 126. As a result, a second length 128 of the deadline 72 is longer than the first length 114. In other words, a longer segment of the deadline 72 is between the stationary compensator assemblies 80*a*, 80*d* while the second load condition 116 acts on the deadline 72. Accordingly, the slack in the deadline resulting from the second load condition 116 is substantially removed due to the deadline compensator 70.

In the illustrated embodiment, the first compensator assembly 80*c* has a first surface area 130 and the second compensator assembly 80*b* has a second surface area 132. The first surface area 130 is larger than the second surface area 132, thereby enabling the first and second compensator assemblies 80*c*, 80*b* to produce a different first force 120 and second force 122. Accordingly, the first and second forces 120, 122 may be varied for existing design conditions. For example, in embodiments where the traveling block 22 weighs approximately 6,000 pounds, the first compensator assembly 80*c* may include the first surface area 130 such that the first force 120 is equal to approximately 6,000 pounds. As a result, the slack in the deadline 72 may be sufficiently dampened using only the first compensator assembly 80*c*. Moreover, the second compensator assembly 80*b* may be sized to generate the second force 122 such that the combination of the first and second forces 120, 122 is approximately equal to the weight of the traveling block 22 plus the tubular 38 and/or any other drilling components coupled to the traveling block. Accordingly, simultaneous activation of the first and second compensator assemblies 80*c*, 80*b* may dampen the slack in the deadline 72 while the traveling block 22 is fully loaded with drilling equipment.

Figure 5:
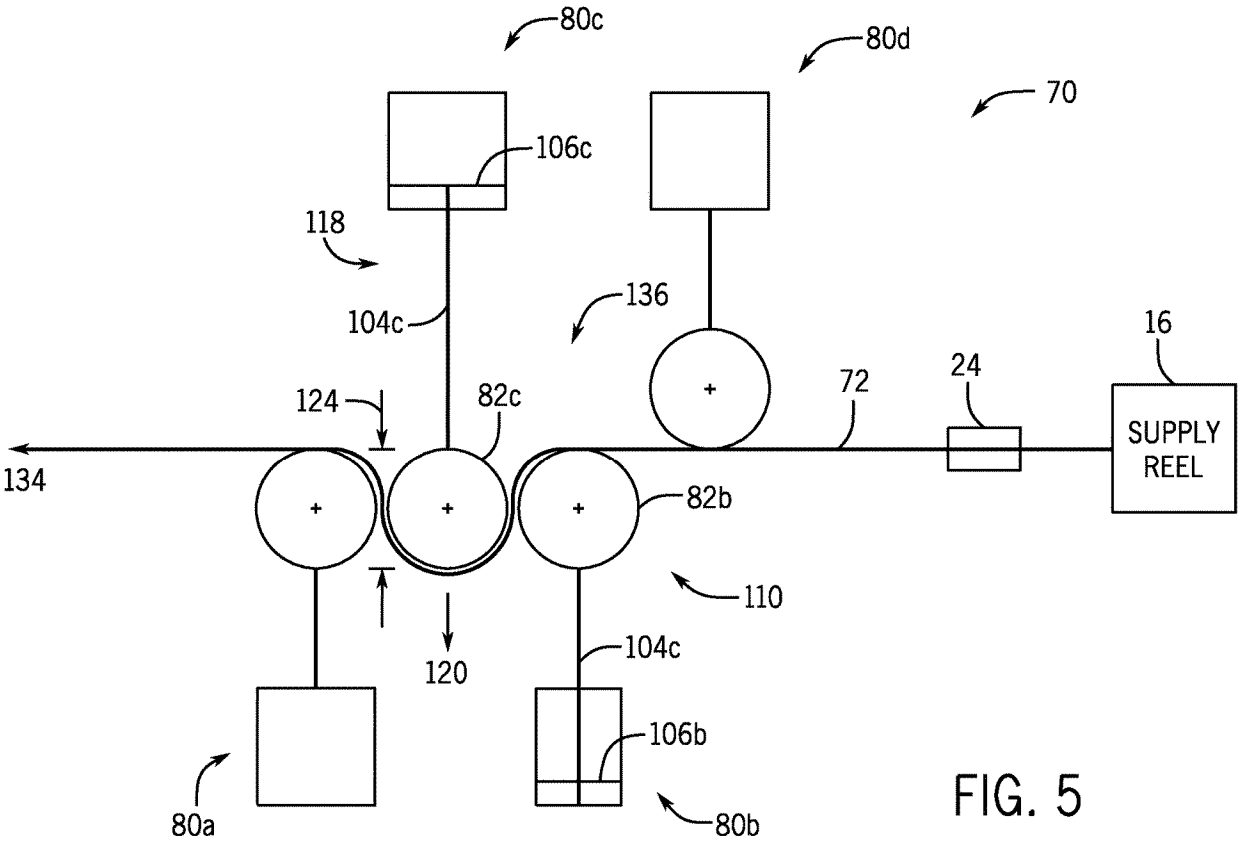
FIG. 5 is a schematic of the deadline compensator of FIG. 2, in which a third load condition is acting on the deadline, in accordance with present techniques.

FIG. 5 is a schematic diagram of the deadline compensator 70 in which a third load condition 134 is applied to the deadline 72. As described above, the third load condition 134 may represent the load applied to the deadline 72 after the tubular 38 is coupled to the drill string 28. That is, the third load condition 134 may represent the weight of the traveling block 22 and other associated drilling components (e.g., sensors, the top drive 42, etc.). In the illustrated embodiment, the first compensator assembly 80*c* is in the second position 118 while the second compensator assembly 80*b* is in the first position 110. This is because, the first force 120 is sufficient to dampen the slack in the deadline 72 without moving the second compensator assembly 80*b* into the second position, in the illustrated embodiment. As mentioned above, the first compensator assembly 80*c* may be designed such that the first force 120 is sufficient to dampen the slack in the deadline 72 during the third load condition 134, while the second compensator assembly 80*b* may be designed to supply additional force during the second load condition 134.

In the illustrated embodiment, the first compensator assembly 80*c* displaces the deadline 72 the first distance 124. As mentioned above, the additional line occupied by the first distance 124 may be sufficient to remove the slack from the deadline 72 while the deadline 72 is under the third load condition 134. As a result, a third length 136 is disposed within the deadline compensator 70 (e.g., between the stationary compensator assemblies 80*a*, 80*d*). The third length 136 is longer than the first length 114, thereby maintaining tautness in the deadline 72 during the drilling operations.

In operation, the first and second compensator assemblies 80*c*, 80*b* may be configured to continuously apply the first and second forces 120, 122 to the deadline 72. For example, the first compensator assembly 80*c* may be configured to apply the first force 120 to the deadline 72 while the first load condition 112 is applied to the deadline 72. Because the force applied to the deadline during the first load condition 112 is larger than the first force 120, the deadline 72 will be not displaced. As a result, the deadline 72 maintains the first length 114 during the first load condition 112, even if the first and second compensator assemblies 80*c*, 80*b* are applying the first and second forces 120, 122 to the deadline 72.

Moreover, in embodiments where a continuous force is applied to the deadline 72, changes in the load conditions may be automatically adjusted by the first and second compensator assemblies 80*c*, 80*b*. For example, in embodiments where the load condition changes from the first load condition 112 to the second load condition 116, the first and second forces 120, 122 applied by the first and second compensator assemblies 80*c*, 80*b* will displace the deadline 72 once the load condition changes from the first load condition 112 to the second load condition 116. As a result, sudden changes in the load condition applied to the deadline 72 may be accounted for via the deadline compensator 70.

However, in other embodiments, the controller 56 may receive a signal indicative of a load on the deadline 72. For example, a sensor may be positioned on the traveling block 22 configured to detect increased loads applied to the traveling block. Moreover, the deadline 72 may include a sensor that detects strain in the deadline 72. The controller 56 may evaluate the signal. For example, the controller 56 may determine the magnitude of the load on the deadline 72 using a computer readable program stored on the memory 60. Thereafter, the controller 56 may send a control signal to the moveable compensator assemblies 80*b*, 80*c* instructing the moveable compensator assemblies 80*b*, 80*c* to extend or retract the piston rods 104*b*, 104*c*. For example, the controller 56 may send a control signal to the compensator assemblies 80*b*, 80*c* indicating that the second load condition 116 is applied to the deadline 72. As a result, the first and second compensator assemblies 80*c*, 80*b* may extend the piston rods 104*c*, 104*b* to apply the first force 120 and the second force 122 to the deadline 72. In certain embodiments, the control signal may activate the pump coupled to the fluid reservoir 100 to drive the fluid toward the first and second compensator assemblies 80*c*, 80*b*. Accordingly, the method 140 may be utilized to apply the first and second forces 120, 122 to the deadline 72 during drilling operations to remove slack from the deadline 72.

As described in detail above, the deadline compensator 70 is configured to displace the deadline 72 during load conditions in which the deadline 72 includes some slack. For example, the deadline compensator 70 includes compensator assemblies 80 configured to apply forces to the deadline 72 to displace the deadline 72 and maintain tautness in the deadline 72 during drilling operations. For example, while the second load condition 116 is applied to the deadline 72, both the first and second compensator assemblies 80*c*, 80*b* may move to the second position 118 to apply the first and second forces 120, 122 to the deadline 72. The first and second forces 120, 122 displace the deadline 72 within the deadline compensator 70, thereby removing the slack from the line as a result of the second load condition 116. As a result, obstructions encountered by the tubular 38 as the tubular 38 is lowered toward the rig floor 12 may be accounted for by the dampening provided by the compensator assemblies 80.

While only certain features of disclosed embodiments have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A deadline compensator, comprising:

a compensator assembly configured to engage a deadline between a crown block and a supply reel, wherein the compensator assembly is configured to transition between a first position and a second position;

at least one compensator sheave of the compensator assembly, wherein the compensator sheave is configured to engage the deadline;

at least one actuator of the compensator assembly, wherein the actuator is configured to apply a force to the deadline via the at least one compensator sheave to displace the deadline while the compensator assembly is in the first position and configured to retract into the second position in response to a second load condition on the deadline; and a sensor engaged to the deadline configured to detect a tension force of the deadline, wherein the sensor communicates a first signal to a controller, and the controller communicates a second signal to the compensator assembly to transition the compensator assembly between the first position and the second position in response to the first signal.

2. The deadline compensator of claim 1, comprising at least two compensator sheaves coupled with respective actuators and engaging substantially opposing sides of the deadline.

3. The deadline compensator of claim 1, wherein the at least one actuator is a hydraulic motor.

4. The deadline compensator of claim 1, comprising a stationary compensator assembly, wherein the stationary compensator assembly comprises a sheave configured to engage the deadline and guide the deadline toward the at least one compensator sheave.

5. The deadline compensator of claim 1, comprising an additional compensator assembly configured to transition between a third and fourth position, wherein the additional compensator assembly comprises an additional compensator sheave coupled with an additional actuator configured to apply an additional force to the deadline, wherein the additional force is in a direction substantially opposite to a direction of the force applied by the at least one actuator.

6. The deadline compensator of claim 5, wherein the force applied by the at least one actuator is greater than the additional force.

7. The deadline compensator of claim 1, wherein the compensator assembly is configured to transition to the second position when a load condition on the deadline applies a threshold amount of force to the deadline.

8. The deadline compensator of claim 7, wherein the load condition comprises a first load condition resulting in substantially no slack in the deadline.

9. The deadline compensator of claim 1, wherein the compensator assembly is configured to transition to one or more positions between the first and second positions corresponding to a load condition on the deadline.

10. The deadline compensator of claim 1, further comprising a traveling block engaged to the deadline.

11. The deadline compensator of claim 10, wherein the sensor is configured to detect a load applied to the traveling block.

12. The deadline compensator of claim 1, wherein the controller includes a memory and one or more microprocessors.

13. The deadline compensator of claim 12, wherein the first signal is representative of the tension force.

14. The deadline compensator of claim 13, wherein the controller is configured to evaluate the first signal.

15. The deadline compensator of claim 14, wherein the controller is configured to generate a magnitude of load on the deadline.

16. The deadline compensator of claim 15, wherein the controller is configured to send instructions to the compensator assembly.

* * * * *